United States Patent [19]

Deitz

[11] 4,405,049

[45] Sep. 20, 1983

[54] CAPSULE INSPECTION DEVICE

[76] Inventor: Stephen J. Deitz, 1707 Certainty Dr., Point Pleasant, N.J. 08742

[21] Appl. No.: 310,799

[22] Filed: Oct. 13, 1981

[51] Int. Cl.[3] ..... B07C 5/36; B07C 7/00

[52] U.S. Cl. ..... 209/630; 209/644; 209/705; 209/938

[58] Field of Search ..... 209/522, 538, 606, 629, 209/630, 644, 701, 702, 705, 938, 940, 942

[56] References Cited

U.S. PATENT DOCUMENTS

| | | | |
|---|---|---|---|
| 2,991,687 | 7/1961 | Henebry | 209/938 X |
| 3,123,217 | 3/1964 | McMillan et al. | 209/644 X |
| 3,612,271 | 10/1971 | Behling | 209/644 |
| 3,637,075 | 1/1971 | Cayton | 209/705 |

*Primary Examiner*—Robert B. Reeves
*Assistant Examiner*—Edward M. Wacyra
*Attorney, Agent, or Firm*—Gordon W. Kerr

[57] ABSTRACT

A medicinal capsule inspection device in which the capsules are arrayed end to end between adjacent rotating rollers and visually inspected as they are rotated by the rollers. The rollers are supported by and roll around a pair of circular ledges comprising the smaller diameters of a pair of parallel, concentric flanged discs. The rollers are driven around the ledges by projections on a pair of rotating discs which are synchronously driven from a common source. A feed chute, discharge outlet, an air ejection system and a light source are provided to facilitate the operation of the device and to facilitate the detection of faulty capsules.

6 Claims, 3 Drawing Figures

CAPSULE INSPECTION DEVICE

BACKGROUND OF THE INVENTION

This invention relates to inspection of medicinal products, and more particularly to a novel and useful device for facilitating the inspection of capsules containing medicinal preparations. Such capsules comprise a pair of telescoping halves of generally cylindrical shape but with hemispheric ends. The two halves, which are of gelatin material, are pushed together into telescopic engagment after the medicinal preparation has been inserted therein. After such capsules are filled it is necessary for an operator to inspect them to detect and remove faulty capsules. The most common type of faults are insufficiently filled capsules and those which not had their halves properly telescoped, or have suffered end damage. The present invention provides a novel device adapted for visual inspection of such capsules in which the capsules are automatically arrayed in groups lined up between rotating rollers. The rotating rollers cause the arrayed capsules carried thereon to continually rotate to facilitate the inspection thereof. A novel mechanism is provided whereby the axes of the rollers continually describe the curved surface of a large cylinder so that the capsules can be fed to one side of the arrayed rollers, carried over the upper portion of the cylinder while they are continually rotated, and the inspected capsules caused to fall into an output hopper at a capsule delivery station near the opposite side of the cylinder. Air jets are provided under the rollers for ejecting or jiggling defective capsules.

SUMMARY OF THE INVENTION

The novel device comprises a feed hopper containing capsules to be inspected. The hopper discharges the capsules to a feed chute or ramp either by means of a vibratory feeder or through gravity. The feed system terminates on the rear side of the array of rotating rollers. A pair of flanged discs are mounted in parallel spaced relationship such that they form the flat end surfaces of the large cylinder. The flanges on the discs are on the outside thereof so that their smaller peripheries or diameters are facing each other. The cylindrical rollers are just long enough to rest on the smaller diameters of the two flanged discs and the array of rollers forms the curved surface of the large cylinder defined by the two flanged discs. A pair of rotating discs are disposed adjacent the inner surfaces of the flanged discs and each has a diameter slightly less than that of the smaller diameter of the flanged discs. The rotating discs have radial projections in the form of pins or teeth which are adapted to drive the rollers around the periphery of the stationary flanged discs. The rollers will thus rotate on the smaller diameter of the flanged discs as they are driven by the radial projections of the rotating discs. The spacing between adjacent rollers is made somewhat less than the capsule diameter so that the capsules as they leave the aforementioned feed chute will fall into the spaces between two adjacent rotating rollers, and themselves be rotated. A shroud or skirt comprising a strip of flat stock is attached to the lower portion of the larger diameter of each of the flanged discs in such a way as to prevent the rollers from falling away from the discs during the lowerportion of their travel. Since the rollers are held in place during their travel only by the force of gravity, the rollers can be easily removed, for example for cleaning or repairing portions of the device within the array of rollers.

The rotating discs are separately driven by a pair of sprockets or the like disposed on either side of the flanged discs and connected to each of the rotating discs by means of hollow shafts which project through central holes in the flanged discs. The two sprockets are driven in synchronism from the same source. An air ejector system is mounted inside the rotating array of rollers and applies air pressure to the underside of the capsules so that lightweight capsules which are empty or only partially filled will be blown off the device, or else jiggled to alert the inspector to the defect. A lamp may be placed within the array of rollers to aid in the inspection. The capsules which pass inspection fall off of the array of rollers and are collected in a bin or fall onto a conveyor.

DETAILED DESCRIPTION OF A PREFERRED EMBODIMENT

Figure 1:
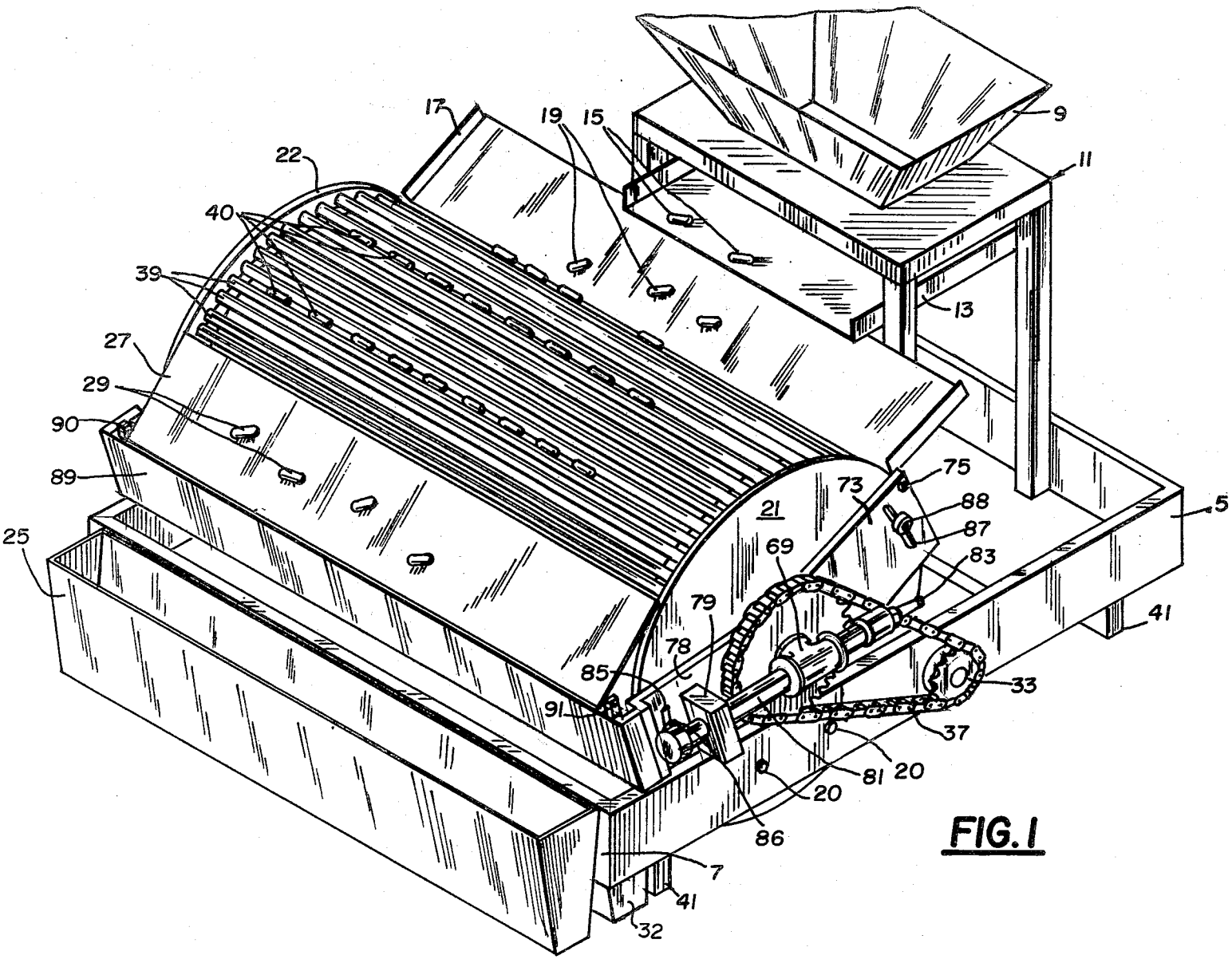
FIG. 1 is an isometric view of the novel device.
Figure 2:
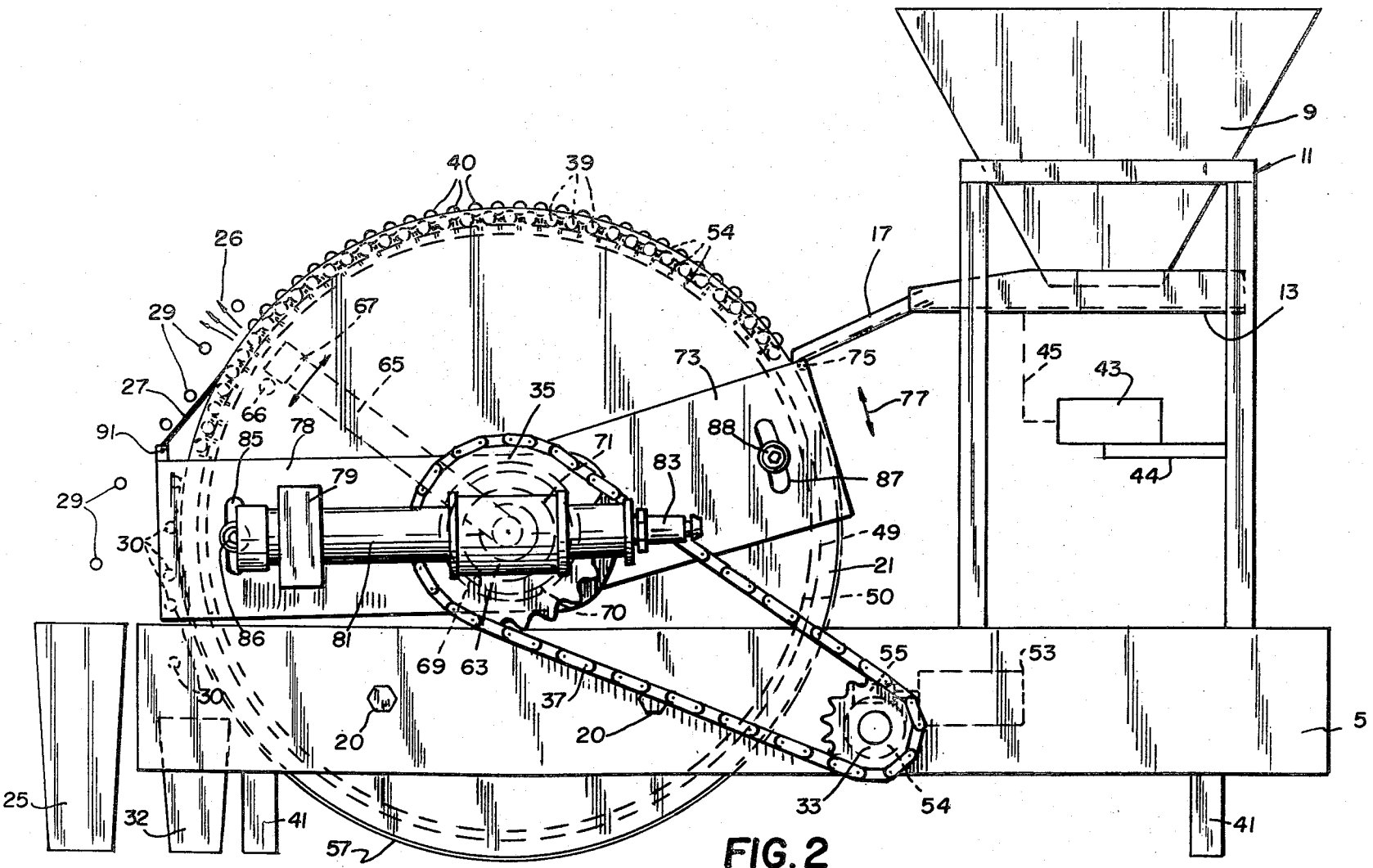
FIG. 2 is a side view of the device.

The illustrative embodiment of FIG. 1 shows a version of the novel capsule inspection device adapted to rest on a tabletop or bench. The device includes a rectangular frame 5 supported by legs 41. Capsules to be inspected are placed in hopper 9 which is supported by framework 11 in such a way that the contents of the hopper are gravity-fed to a vibratory feeding mechanism which includes vibrating tray 13. The tray 13 vibrates in such a way as to move the capsules 15 thereon toward feed chute 17. Chute 17 is downwardly inclined toward the array of rotating rollers 39 at an adjustable angle and the capsules 19 delivered thereto from tray 13 slide down the chute 17 and automatically fall into the spaces between the rotating rollers. The numeral 40 indicates how the capsules thus loaded onto the rollers line up in an end to end array. Each of the rollers is of cylindrical shape and continuously rotates around its axis as it simultaneously revolves around the axis of the two stationary flanged discs 21 and 22. These discs, as shown, are attached to opposite sides of the frame 5 on the inside thereof by fastening means indicated at 20. Thus a given array or line of capsules, such as 40, will be carried across the top of the cylinder formed by the flanged discs 21 and 22 plus the rotating rollers 39, and during this travel across the top of the device, each capsule will be continually rotated around its axis in the opposite direction from the rotation the rollers, since each is supported in the space between adjacent rollers. During this travel the capsules are visually inspected. The drive means for rotating the rollers and revolving them around the large cylinder is illustrated in FIGS. 2 and 3 and will be explained in connection therewith.

The feed chute 17 is supported by a three-sided moveable frame which pivots around the centers of the stationary discs, so that the chute position can be varied somewhat to optimize the feeding of the capsules to the array of rollers. One side of this frame, 73, is shown in FIGS. 1 and 2. Side 73 has a hole in it, not shown, which fits over the raised hub 70 of disc 21, shown in FIG. 3. The frame extends across the back of the device, under the chute 17. The third part of the frame is another part like side 73 which engages the hub 72 of the other stationary disc, also shown in FIG. 3. The chute 17 is attached to the frame by attachment means 75, shown in FIGS. 1 and 2, and a similar means at the other end of the feed chute. When the feed chute has been adjusted to its optimum position, a locking screw 88, which is threaded into the side of disc 21 is tightened against the top of arcuate slot 87. The feed chute is adjusted so that only a single layer or line of capsules will array themselves between adjacent rollers, and any excess capsules will fall back toward the chute due to gravity. In addition to this chute adjustment, a photocell may be arrayed to detect the accumulation of excess capsules and stop the vibratory feeding mechanism until the excess of capsules is reduced.

A chute 27, which may comprise a rectangular piece of flat stock with a width approximately equal to the length of each roller, is attached to a forward moveable frame similar to that which supports and provides adjustment for the feed chute 17. The chute 27 is hinged to frame member 89 at 90 and 91 so that the chute 27 can rest against the peripheries of the two flanged discs 21 and 22 at a point just above where the capsules fall off of the rollers due to gravity. The side frame member 78 connects to member 89 and member 78 fits over raised hub 70 outside of the side member 73. The third side of this frame is similar to 78 but fits over hub 72 of the other flanged disc 22. This forward frame is adjustable around the center of the two stationary discs and can be locked in position by means of slot 85 and locking screw 86.

Figure 3:
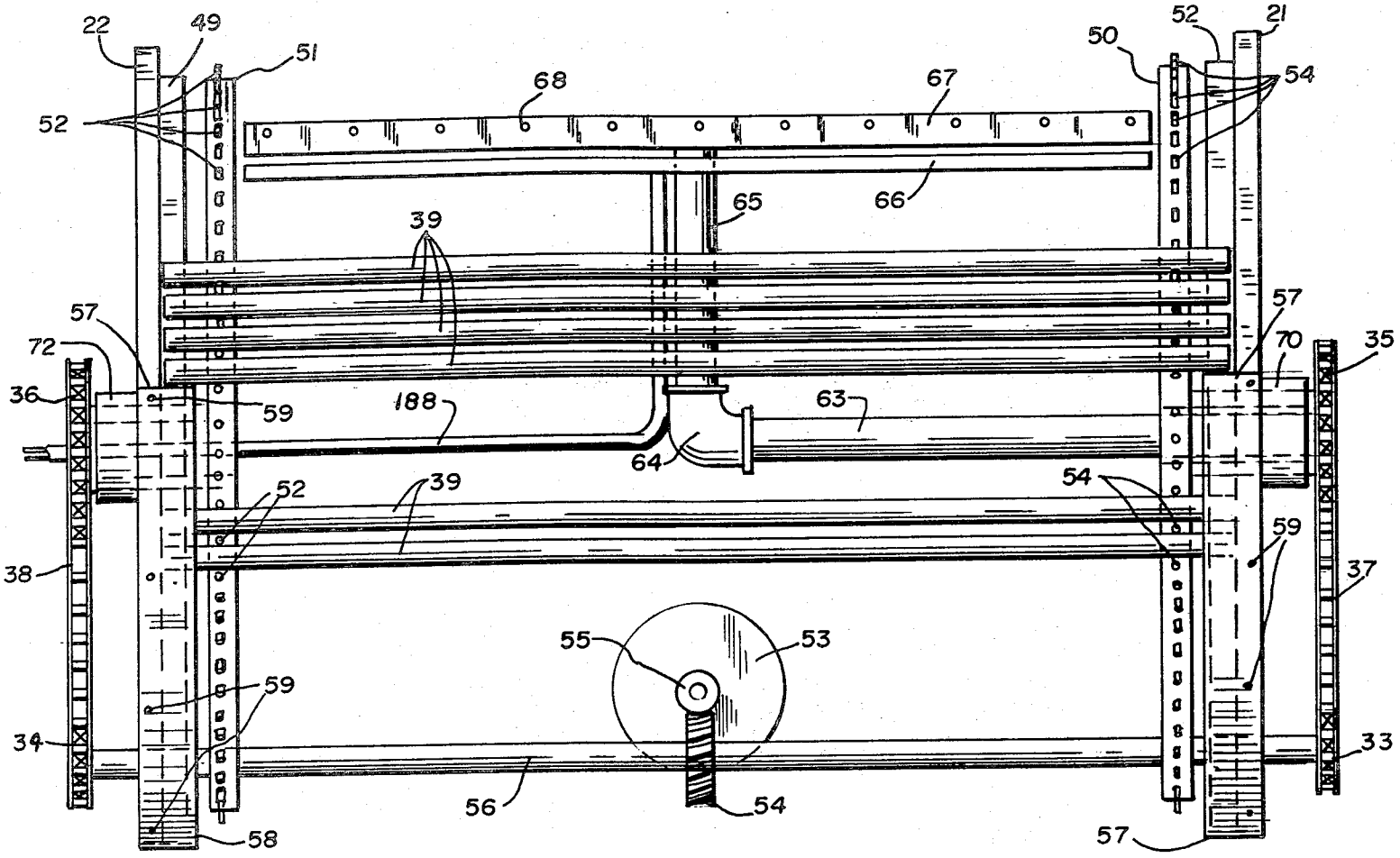
FIG. 3 is a front view of the device showing the output thereof.

The air ejector system comprising a plenum 67 supported by air supply pipe 65 is mounted inside the array of rollers and parallel thereto, as seen in FIG. 3. The plenum 67 is arranged just above the top of the chute 27, as seen in FIG. 1, and is attached to and adjustable with the forward frame which adjusts the position of chute 27. Thus the plenum 67 will always be a fixed distance above the top of the chute 27. The plenum has holes 68 therein, seen in FIG. 3, from which an air stream 26 issues, which can blow lightweight or empty capsules 29 off the device before they reach the chute 27. This action is optimized by adjusting the forward frame. Also, the air pressure can be made adjustable to optimize this function. Also, the forward frame and the air pressure can be adjusted so that empty capsules will be blown off and lightweight or partially filled capsules will be jiggled so that such defective capsules can be removed by the inspector. A special tool may be provided for removing such capsules, for example a vacuum pick off device manually operated by the inspector. The capsules 29 which are blown off as shown in FIG. 2 fall into the reject bin 25. The good capsules 30 continue travelling around the roller system until they fall off due to gravity. An output bin 30 may be provided to catch the good capsules or they may fall onto a conveyor, not shown. The reject bin 25 may be attached to or made integral with the chute 27.

The side view of FIG. 2 and the front view of FIG. 3 illustrate certain features not shown in FIG. 1. The vibratory tray 13 is driven by an electrical vibrator 43, connected to the tray by a linkage indicated by the dashed line 45. The vibrator is supported by bracket 44 attached to framework 11. The drive system for the rotating discs and the rollers comprises the motor 53 which drives a worm 55 which in turn drives worm gear 54, best illustrated in FIG. 3. Worm gear 54 is attached to and drives a traversely mounted shaft 56 which carries two sprockets, 33 and 34, at opposite ends thereof. The sprocket 33 drives sprocket 35 as described previously and sprocket 34 drives another similar sprocket 36 on the opposite side of the device, via chains 37 and 38.

FIG. 3 shows most of the rollers as well as the frame, the chute 27 and the moveable frames removed to better illustrate features inside the array of rollers and the novel drive mechanism for the rollers. As stated, the two stationary flanged discs 21 and 22 are mounted in parallel relationship against opposite inside walls of frame 5, with their centers aligned. The smaller diameters of both flanged discs, referenced as 49 and 52 are arranged on the inside, facing each other, to form a pair of circular ledges on which the rollers 39 rest and roll as they traverse the top portion of the device. As shown, each roller is just long enough so that it can rest on the smaller diameters or peripheries of the flanged discs, but not touch the flanges.

The rotating drive disc 50 is mounted adjacent to and inside of flanged disc 21, and concentric therewith. Similar drive disc 51 is mounted adjacent the other flanged disc 22. The diameters of discs 50 and 51 are slightly less than the smaller diameter of the two flanged discs, so that the peripheries of the two rotating discs do not touch the rollers. The disc 50 has an array of radial projections 54 which may be pins inserted therein or teeth integral with the disc, with the spacing between adjacent projections being somewhat more than the diameter of the rollers. The other rotating disc, 51, has a similar array of projections 52 thereon, similarly spaced. The rotating discs are synchronously rotated from the same drive means, namely the motor 53 and the mechanism connected thereto and are phased or aligned so that the gaps between adjacent projections thereon will track each other as the two discs are rotated. The projections are made long enough to project outward between adjacent rollers and impell them around the stationary flanged discs. The side view of FIG. 2 illustrates the relative diameters of the flanged disc 21, the smaller diameter 49 thereof, the rotating disc 50 with the projections 54 thereon and the rollers disposed between adjacent projections but rolling along the smaller diameter 49 of disc 21. As viewed in FIG. 2, the rotating discs as well as the rollers 39 would rotate counter clockwise, while the capsules 40 would be rotated in a clockwise direction but at a higher speed than the rollers because of the smaller diameter of the capsules.

It is obvious that the rollers would fall off of the device after the pins 54 reach the horizontal position near the chute 27. In order to prevent this, a shroud or skirt 57, seen in FIG. 3, is attached to the outer periphery of each of the flanged discs 21 and 22. These skirts may comprise merely a strip of flexible flat stock which is attached to the discs by means of screws or rivets 59. The skirts extend inwardly to cover the ends of the rollers and prevent them from falling off during their travel around the lower part of the device. These skirts should extend for about 200° around the lower portions of the flanged discs and would begin just below the top of the chute 27 and extend almost to the feed chute 17. Since no capsules are carried between these two points, the rollers are not functional at this time and will simply be rolled along the inner surface of the skirts 57 by the projections 52 and 54.

The sprocket 35 is connected to rotating disc 50 by means of a sleeve which passes through a hole 69 of the hub 70 of flanged disc 21. The dashed circle 71 represents the inner diameter of this sleeve. Inside of the sleeve and concentric therewith is an air pipe 63 which extends to the center of the cylinder formed by the array of rollers. A 90° joint 64 connects with another pipe 65 which supplies the horizontal plenum 67 which is disposed just behind the array of rollers near the top of the device. Plenum 67 has an array of holes 68 therein directed at the rollers as they pass it by. As stated, the purpose of this air ejector is to eject lightweight capsules or jiggle them to make their presence known. The air supply pipe 63 projects through sprocket 35 to a T-joint which has an air hose nipple 83 at one end thereof, and the other end of the pipe, 81, passes through metal block 79 which is attached to frame member 78. This connection of the air ejector system to the forward frame permits the plenum 67 and output chute to be adjusted in unison, as explained above.

A light source, for example, fluorescent tube 66 may be attached to the plenum 67, as shown in FIG. 3. This lamp would be supplied with power from a pair of leads 188 which project through the hollow sleeve which connects sprocket 36 with drive disc 51.

The rollers may be metal or plastic and may be solid or hollow. When it is necessary to remove the rollers for cleaning or to gain access to the interior of the device, the chute 27 can be moved on its hinges away from the rollers and the rollers simply lifted off the device as they pass across the top of the large cylinder.

While the invention has been described in connection with an illustrative embodiment, obvious modifications will occur to those skilled in the art, accordingly the invention should be limited only by the scope of the appended claims.

I claim:

1. A capsule inspection device comprising a pair of stationary flanged discs mounted in spaced parallel vertical planes with their centers aligned to define the ends of a large cylinder, the smaller diameters of said flanged discs facing each other, each said flanged disc having a rotating disc mounted adjacent thereto and parallel and concentric therewith, said rotating discs being between said flanged discs and having smaller diameters than said flanged discs, said rotating discs having radial projections therein, skirts attached to the lower portions of the larger diameters of said flanged discs and extending inwardly toward said rotating discs, an array of rollers forming the curved surface of said large cylinder, said rollers being slightly shorter than the spacing between the flanges of said flanged discs so that they rest on the smaller diameter of said flanged discs between adjacent radial projections of said rotating discs, the diameter of said rollers and the spacing between them being chosen so that medicinal capsules to be inspected can array themselves in linear arrays between adjacent rollers and be rotated thereby, means to sychronously drive said rotating discs from a common source, capsule supply means at the rear of said array of rollers and a capsule discharge means at the front of said array rollers.

2. The device of claim 1 wherein said means to drive said rotating discs comprises a motor which synchronously drives a pair of sprockets mounted concentrically with all of said discs, each of said sprockets driving its rotating disc through a hollow shaft projecting through the adjacent flanged disc.

3. The device of claim 2 wherein said capsule supply means comprises a hopper which discharges its contents into a vibrating tray which conveys capsules to be inspected to an adjustable feed chute which terminates near the rear side of said array of rollers, and wherein said discharge means comprises means to collect capsules which fall off of said array of rollers due to gravity.

4. The device of claim 3 further including an air ejector system comprising a plenum mounted inside of said array of rollers and just above the top of an output chute, said plenum being supplied with air through one of said hollow shafts which drives one of said rotating discs, said plenum being adjustable by the same mechanism which adjusts the position of said output chute, and a light source within said array of rollers, the leads for said light source passing through the other of said hollow shafts.

5. A medicinal capsule inspection device comprising, an array of rotating rollers spaced so that capsules can be supported and rotated between adjacent rollers, means to support said rollers on a pair of circular ledges comprising the smaller diameters of a pair of parallel, concentric flanged discs, means to synchronously turn opposite ends of each roller so that capsules carried between said rollers will be continually rotated as they are carried from one side of said device to the other, capsule feeding means on one side of said array of rollers and capsule discharge means on the other side thereof.

6. A capsule inspection device comprising, a circular array of rotating rollers spaced so that capsules can be supported and rotated between adjacent rollers, opposite ends of each of said rollers resting on circular ledges, drive means separate from said circular ledges to roll said rollers around said ledges, thus rotating said rollers, means to feed capsules to be inspected to one side of said array of rollers and output means to remove capsules from the other side of said array of rollers, said rollers being held in place only by the force of gravity whereby said rollers may be quickly and easily removed.

* * * * *